US007175298B2

(12) United States Patent
Schou

(10) Patent No.: US 7,175,298 B2
(45) Date of Patent: Feb. 13, 2007

(54) LANTERN WITH A MULTIPLE LIGHTING EFFECT LENS AND SWIVEL LIGHT SOURCE

(76) Inventor: Soren Schou, 401-1970 W. 41st Avenue, Vancouver, BC (CA) V6M 1Y4

( * ) Notice: Subject to any disclaimer, the term of this patent is extended or adjusted under 35 U.S.C. 154(b) by 0 days.

(21) Appl. No.: 11/420,609

(22) Filed: May 26, 2006

(65) Prior Publication Data

US 2006/0268541 A1 Nov. 30, 2006

Related U.S. Application Data

(60) Provisional application No. 60/595,004, filed on May 26, 2005.

(51) Int. Cl.
*F21V 35/00* (2006.01)

(52) U.S. Cl. ..... 362/166; 362/161; 362/163; 362/179; 362/311; 362/356; 362/360

(58) Field of Classification Search ..... 362/159, 362/161, 163, 166, 169, 171–174, 178–182, 362/186, 266, 311, 312, 315, 351, 355, 356, 362/360, 363

See application file for complete search history.

(56) References Cited

U.S. PATENT DOCUMENTS

| | | | | |
|---|---|---|---|---|
| 4,599,683 | A | 7/1986 | Beckham et al. | |
| 6,595,771 | B2 * | 7/2003 | Chu | 431/291 |
| 2001/0043469 | A1 * | 11/2001 | Carpenter et al. | 362/161 |

* cited by examiner

*Primary Examiner*—Laura K. Tso

(57) ABSTRACT

The present invention provides lanterns that have a globe or lens with portions that differ in their light transmitting characteristics such that each portion provides a different illuminating effect, and a candle or other light source held within the globe or lens on a holder that is able to swivel or rotate in relation to the globe or lens. This enables the lantern to be positioned such that light from the light source passes primarily through either one of the lens portions for the desired illumination characteristic.

18 Claims, 3 Drawing Sheets

LANTERN WITH A MULTIPLE LIGHTING EFFECT LENS AND SWIVEL LIGHT SOURCE

CROSS-REFERENCE TO RELATED APPLICATIONS

The present application claims priority from U.S. provisional patent application No. 60/595,004 filed May 26, 2005. This and all other references referenced herein are incorporated herein by reference in their entirety and for all their teachings and disclosures, regardless of where the references may appear in this application.

BACKGROUND OF THE INVENTION

The present invention relates generally to lanterns, and more specifically, to a lantern with more than one light transmitting portions on the globe or lens to allow for a choice of illuminating effects.

SUMMARY OF THE INVENTION

The present invention provides lanterns that have a globe or lens with portions that differ in their light transmitting characteristics such that each portion provides a different illuminating effect, and a candle or other light source held within the globe or lens on a holder that is able to swivel or rotate in relation to the globe or lens. This enables the lantern to be selectively positioned such that light from the light source passes primarily through either one of the lens portions for the desired illumination characteristic.

BRIEF DESCRIPTION OF THE DRAWINGS

For a better understanding of the present invention and to show more clearly how it may be carried into effect, reference will now be made by way of example to the accompanying drawings in which.

DETAILED DESCRIPTION

Figure 1:
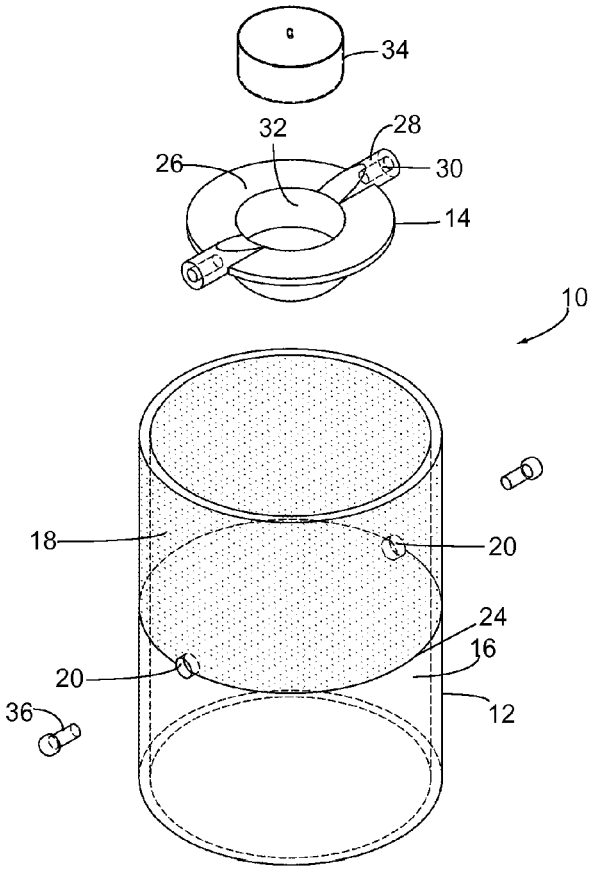
FIG. 1 is an exploded view of an embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention. Therefore, specific details disclosed herein are not to be interpreted as limiting, but rather as a basis for the claims and as a representative basis for teaching one skilled in the art to employ the present invention.

Figure 2:
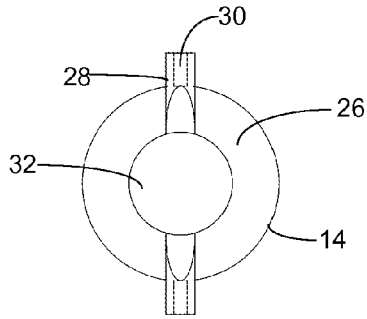
FIG. 2 is a top plan view of the candle holder of the embodiment illustrated in FIG. 1.
Figure 3:
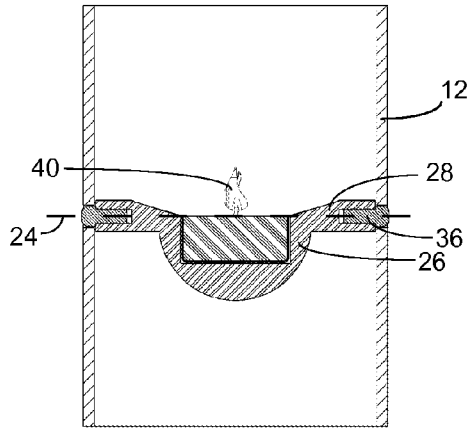
FIG. 3 is a longitudinal section of the embodiment illustrated in FIG. 1.

Referring to FIGS. 1–3, an embodiment of a lantern of the present invention is generally indicated at 10, and is a tealight candle lantern. Device 10 comprises a cylindrical globe or lens 12 that is made of glass or other suitable transparent or translucent material, and a candle holder or cradle 14, made of metal, plastic or other suitable material, that is mounted within the internal cavity defined by the lens in a manner such that it may swivel or rotate about an axis of rotation in relation to the lens.

Lens 12 is divided into first and second light transmitting portions, wherein each portion is adapted to transmit light of a different visual quality than the other portion, such as a transparent portion 16 and a frosted portion 18. However, each of the light transmitting portions of the lens 12 may be otherwise treated in order to achieve a desired illumination effect. For example, one portion may be frosted and the other portion may be colored, or both may be colored a different hue. In the illustrated embodiments, the lens 12 is adapted to being placed directly on a horizontal display surface such as a tabletop, shelf or the like, without the use of an external housing or stand. However, the present invention may also be embodied in variations in which a lens is received in a housing or stand that is placed on the surface. Lens 12 is provided with axially aligned, diametrically opposed mounting holes 20 that are positioned on the transverse medial plane 24 of the lens, which also coincides with a transition zone where the portions 16 and 18 meet.

Candle holder 14 comprises a central body 26 that has axially aligned, diametrically opposed arms 28, each of which is provided with a mounting hole or bore 30, and a cylindrical cavity 32 that is adapted to receive a tealight candle 34. The bore 30 of each arm 28 aligns with a respective mounting hole 20 on the lens 12 when the candle holder 14 is positioned within the lens. Two mounting pins 36 are provided for mounting the candle holder within the lens, wherein each pin is inserted into a respective hole on the lens and into a respective bore on the candle holder. In the illustrated embodiment, the pins fit snugly into bore 30 on the arms, but are free to rotate in holes 20 such that the candle holder 14 is able to swivel in relation to the lens about an axis of rotation defined by the pins. In other embodiments, the same result may be accomplished with the pins fitting snugly into the hole on the lens but loosely within the bore on the arms.

Referring to FIGS. 2 and 3, the arms 28 are aligned along the medial plane 24 of the candle holder, and the bulk of the central body 26 is below the arms such that the bulk of a candle held therein is also below the arms. Accordingly, the centre of gravity of the candle holder 14 is balanced about the axis of rotation defined by the pins such that the candle holder supports a candle within it in an upright orientation. In addition, it is preferable that the candle within the candle holder is positioned in a manner that a flame 40 of a lit candle is above the transition zone between portions 16 and 18 (i.e. the medial transverse plane of the illustrated embodiment) so that the illumination from the candle passes primarily through only one of the light transmitting portions.

In use, the characteristics of illumination from the device 10 may be selected between the effects provided by the portions 16 and 18 by flipping the device so that a flame from the candle is positioned within the desired portion by virtue of the candle holder's 14 ability to swivel in relation to the lens 12.

Figure 4:
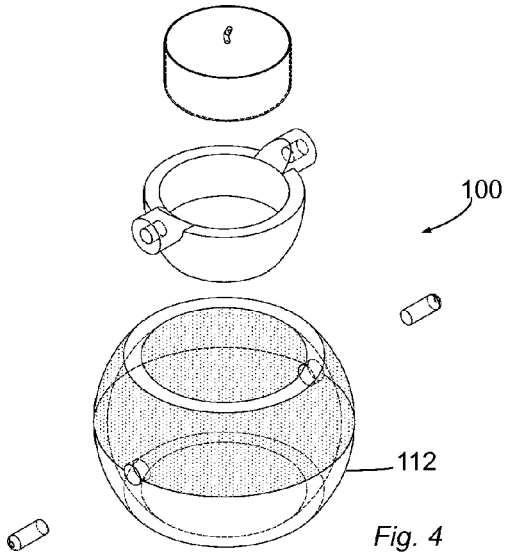
FIG. 4 is an exploded view of another embodiment of the present invention.

Referring to FIG. 4, another embodiment of a tealight candle lantern in accordance with the present invention is generally indicated at 100. Device 100 differs from device 10 primarily in that the lens 112 is partly spherical to illustrate that lens shapes other than cylindrical may be used. In other respects, device 100 is similar to device 10. Accordingly, the present invention encompasses embodiments employing a variety of lens shapes and illuminating effects.

Figure 5:
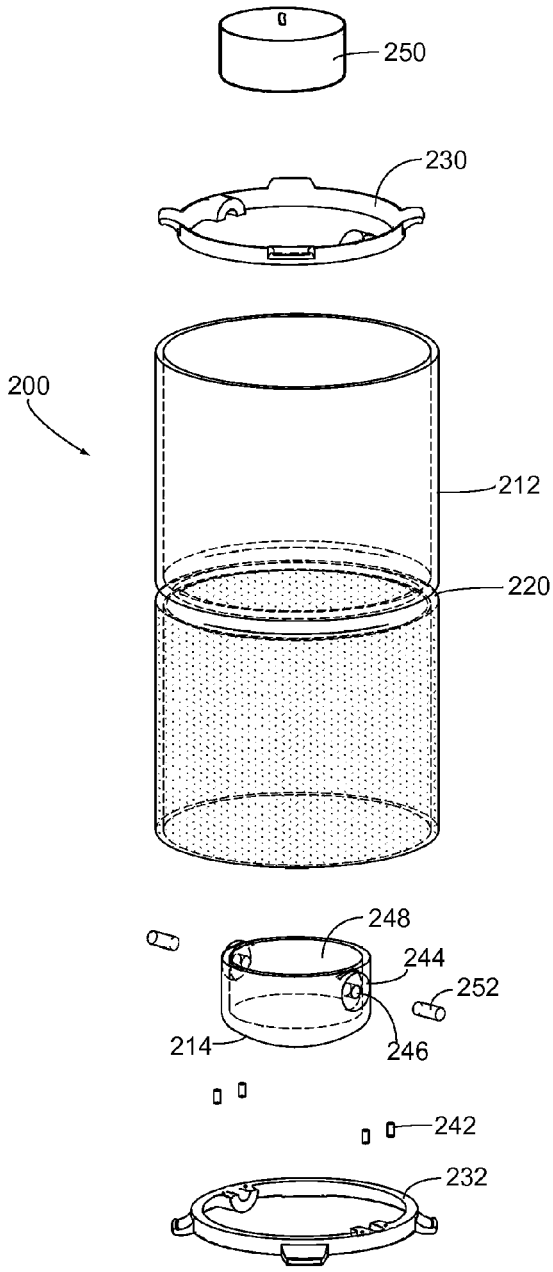
FIG. 5 is an exploded view of yet another embodiment of the present invention.
Figure 6:
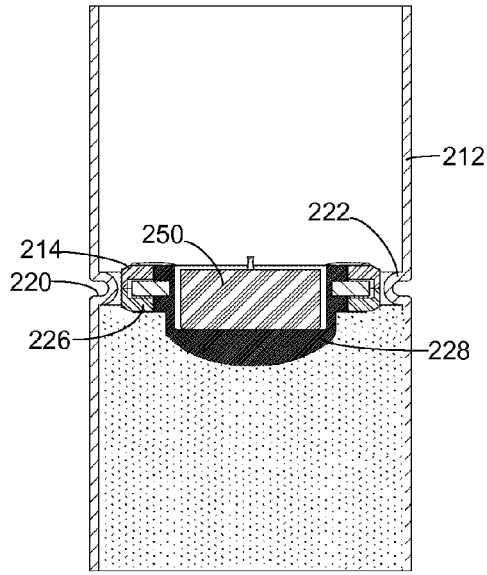
FIG. 6 is a longitudinal section of the embodiment illustrated in FIG. 5.
Figure 7:
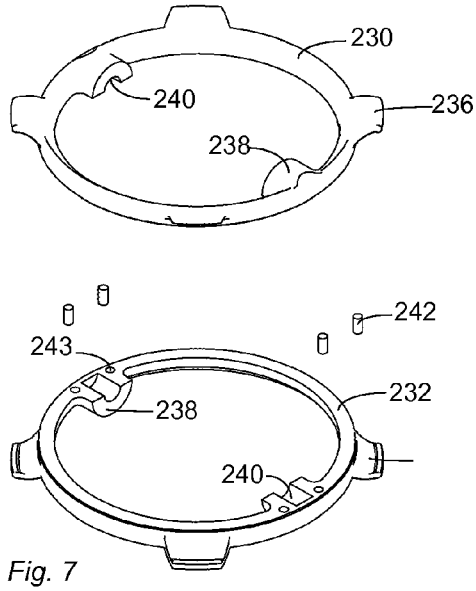
FIG. 7 is a perspective view of the two halve-ring elements of the embodiment illustrated in FIG. 5.

Referring to FIGS. 5–7, another embodiment of a tealight candle lantern in accordance with the present invention is generally indicated at 200 comprising of a globe or lens 212 and a candle holder 214 that is mounted within the lens in a manner such that a portion of it may swivel in relation to the lens.

Lens 212 is divided into a different lighting effect portions, analogous to those described above in relation to device 10, along the medial transverse plane of the lens. However, the lens includes a circumferential narrowing, constriction or stricture 220, also at the medial transverse plane, which invades the internal cavity of the lens to define a ridge 222 upon which is mounted candle holder 214.

Candle holder 214 comprises ring support 226, adapted to engage ridge 222, and a central body 228 mounted on the ring support so as to be able to swivel in relation thereto. Ring support 226 includes two halve-ring elements 230 and 232 that are mirror images of each other. Each element includes retaining means or circumferential tabs 236 and two axially aligned, diametrically opposed arm portions 238, each defining a groove 240 therein. The elements are dimensioned to fit within the internal cavity of lens 212 adjacent ridge 222 such that the tabs 236 on each element engage the ridge when the two elements are connected to each other by screws 242 received in threaded holes 243 during assembly of device 200. Of course, the elements may be connected to each other by other means such as pins, studs, rivets and the like, or they may be bonded or magnetically coupled. The central body 228 has diametrically opposed connector portions 244, each of which is provided with a bore 246, and defines a cylindrical cavity 248 that is adapted to receive a tealight candle 250. The bore 246 of each connector portion 244 aligns with a respective groove 240 on each ring element, and pins 252 that are inserted into the bore 246 and into the grooves 240 between sandwiched ring elements enables the central body 228 to swivel in relation to the ring support 226, hence the lens 212, about an axis of rotation defined by the pins 252.

As with the other illustrated embodiments, the ridge 222 and connector portions 244 are aligned along the medial plane of the candle holder, and the bulk of the central body 228 is below the connector portions such that the bulk of a candle held therein is also below the arms. Thus, the centre of gravity of the candle holder 214 is balanced about the axis of rotation defined by the pins 252 such that the candle holder supports a candle within it in an upright orientation. In addition, it is preferable that the candle within the candle holder is positioned in a manner that the flame of a lit candle is above the transition zone between the illumination portions (i.e. the medial transverse plane of the illustrated embodiment) so that the illumination from the candle passes primarily through only one of said portions.

Figure 8:
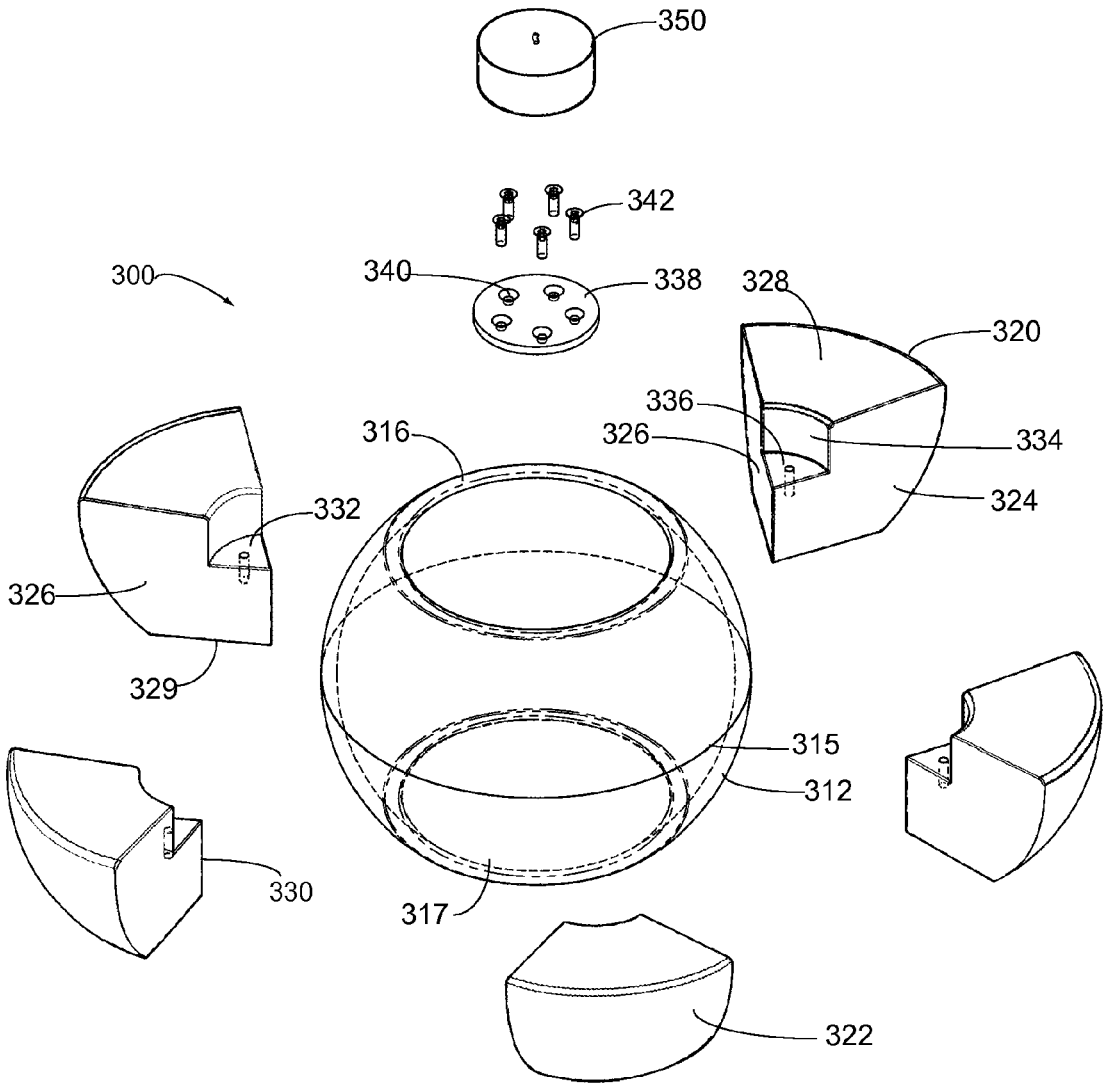
FIG. 8 is an exploded view of yet another embodiment of the present invention.

Referring to FIG. 8, another embodiment of a tealight candle lantern in accordance with the present invention is generally indicated at 300 comprising of a spherical globe or lens 312 defining a spherical internal cavity within which is a hemispherical candle holder movably mounted within the lens in a manner such that it may rotate in relation to the lens. The spherical lens 312 is divided into a different lighting effect portions analogous to those described above in relation to device 10, along the medial transverse plane 315 of the lens, and includes opening 316 and 317.

The hemispherical candle holder comprises five interconnecting pieces such as connectable wedges 320, each defining a pie shaped portion (when view from above) of the hemispherical candle holder. Of course, the actual number of wedges may vary, though the maximum size of each wedge (hence the minimum number of wedges) is determined by the size of the openings 316 and 317 through which the wedges must be passed in order to assemble the device. Each wedge includes a spherical outer wall 322, two sides 324 and 326, each one abuts a side of adjacent wedge sections in the assembled hemispherical candle holder, a top 328 and bottom 329. At the apical edge 330 of each wedge, on the top 328, is defined a ledge portion 332 and a semi-cylindrical wall 334. In the assembled hemispherical candle holder, the ledge portions 332 and semi-cylindrical walls 334 of all wedges define a cylindrical cavity that is adapted to receive a tealight candle 350. Each ledge portion 332 includes a threaded hole 336 for receiving a mounting screw 342. A circular connector disk 338 having corresponding countersunk mounting holes 340 is used to interconnect the wedges by means of the screws 32 passing through the mounting holes 340 into threaded holes 336 on each wedge.

In assembly of the device 300, the wedges 320 are placed into the lens 312 through either opening 316 or 317, and are positioned such that the apical edge 330 of each wedge is in the centre and the top 328 is facing upward. The circular connector disk 338 is placed into the cylindrical cavity defined by the ledge portions 332 and semi-cylindrical wall 334 of the unified wedges so that it rests on the ledge portion of each wedge. The countersunk mounting holes 340 align with the threaded holes 336 on the wedge and the connector disk is then fastened to the wedges by the screws 342. The assembled hemispherical candle holder is thereby confined to the inside of the spherical lens 312 on account of it being larger than either opening 316 or 317, but it may be rotated within the lens to enable the lens to be oriented in a manner that allows illumination from a lit candle held within the hemispherical candle holder to shine primarily through the desired lighting effect portion.

The above illustrated embodiments are candle lanterns, and in particular, tealight candle lanterns. However, the principles of the present invention may be practiced with other sources of illumination, such as oil lamps and electrical lights for example, without departing from the scope of the invention.

While the above description and illustrations constitute preferred or alternate embodiments of the present invention, it will be appreciated that numerous variations may be made without departing from the scope of the invention.

What is claimed is:

1. A candle lantern comprising:

a lens member having first and second light transmitting portions each of which transmits light of a different visual quality than the other of said light transmitting portions, the lens member further defines an internal cavity and has opposed first and second end portions, each end portion defines an opening to the internal cavity; and a candle holder mounted within the cavity for rotation relative to the lens member about an axis of rotation and being positioned to hold a candle within the cavity in a manner that light from said candle passes primarily through one of said light transmitting portions while the lens member is in a first orientation, and through the other of said light transmitting portions while the lens member is in a second orientation.

2. The device of claim 1 wherein the candle holder has its centre of gravity below the axis of rotation such that the candle holder is maintained upright by gravity during rotation of the lens member in a plane perpendicular to the axis of rotation.

3. The device of claim 2 wherein the first end portion of the lens member is adapted to being placed on a surface for maintaining the lens member in the first orientation, and the second end portion of the lens member is adapted to being placed on a surface for maintaining the lens member in the second orientation.

4. The device of claim 3 wherein the first and second light transmitting portions divide the lens member into two visually distinct halves, and the axis of rotation of the candle holder is situated adjacent a portion of the lens member where the two light transmitting portions meet.

5. The device of claim 4:

wherein the lens member further defines a first pair of mounting holes axially aligned with the axis of rotation of the candle holder;

wherein the candle holder defines a second pair of mounting holes that are axially aligned with each other and with the first pair of mounting holes in the lens member; and further including a pair of mounting pins, each of said mounting pins being received in a one of the first pair of mounting holes and a corresponding one of the second pair of mounting holes for rotatably mounting the candle holder within the cavity of the lens member.

6. The device of claim 4:

wherein the lens member includes a stricture adjacent the portion of the lens member where the two light transmitting portions meet, wherein the stricture extends into the cavity;

further including a ring member having retaining means for engagement with the stricture for mounting the ring member within the cavity; and wherein the candle holder is rotatably connected to the ring member for rotation about the axis of rotation.

7. A lantern comprising:

a lens member having first and second light transmitting portions each of which transmits light of a different visual quality than the other of said light transmitting portions, the lens member further defines an internal cavity and has opposed first and second end portions;

a light source holder mounted within the cavity for rotation relative to the lens member about an axis of rotation and being positioned to hold a light source within the cavity in a manner that light from said light source passes primarily through one of said light transmitting portions while the lens member is in a first orientation, and through the other of said light transmitting portions while the lens member is in a second orientation.

8. The device of claim 7 wherein the light source holder has its centre of gravity below the axis of rotation such that the light source holder is maintained upright by gravity during rotation of the lens member in a plane perpendicular to the axis of rotation.

9. The device of claim 8 wherein the first end portion of the lens member is adapted to being placed on a surface for maintaining the lens member in the first orientation, and the second end portion of the lens member is adapted to being placed on a surface for maintaining the lens member in the second orientation.

10. The apparatus of claim 9 further comprising an electrically powered light bulb mounted on the light source holder.

11. The device of claim 10 wherein the first and second light transmitting portions divide the lens member into two visually distinct halves, and the axis of rotation of the light source holder is situated adjacent a portion of the lens member where the two light transmitting portions meet.

12. The device of claim 11:

wherein the lens member further defines a first pair of mounting holes axially aligned with the axis of rotation of the light source holder;

wherein the light source holder defines a second pair of mounting holes that are axially aligned with each other and with the first pair of mounting holes in the lens member; and further including a pair of mounting pins, each of said mounting pins being received in a one of the first pair of mounting holes and a corresponding one of the second pair of mounting holes for rotatably mounting the light source holder within the cavity of the lens member.

13. The device of claim 11:

wherein the lens member includes a stricture adjacent the portion of the lens member where the two light transmitting portions meet, wherein the stricture extends into the cavity;

further including a ring member having retaining means for engagement with the stricture for mounting the ring member within the cavity; and wherein the light source holder is rotatably connected to the ring member for rotation about the axis of rotation.

14. A lantern comprising:

a lens member having first and second light transmitting portions each of which transmits light of a different visual quality than the other of said light transmitting portions, the lens member further having a spherical internal wall defining a spherical internal cavity, and opposed first and second end portions, each end portion defining an opening to the internal cavity; and a light source holder within the internal cavity and having a spherical outer surface complimentary to the spherical internal wall of the lens member, the light source holder being moveable within the internal cavity such that the light source holder may be positioned to hold a light source within the cavity in a manner that light from said light source passes primarily through one of said light transmitting portions while the lens member is in a first orientation, and through the other of said light transmitting portions while the lens member is in a second orientation, and wherein the light source holder comprises a plurality of interconnecting pieces which are each adapted to being inserted into the cavity through either of said openings but when said interconnecting pieces are assembled, the resulting light source holder is larger than said openings and is confined within the cavity of the lens member.

15. The device of claim 14 wherein the assembled light source holder is hemispherical.

16. The device of claim 15 wherein the first end portion of the lens member is adapted to being placed on a surface for maintaining the lens member in the first orientation, and the second end portion of the lens member is adapted to being placed on a surface for maintaining the lens member in the second orientation.

17. The device of claim 16 wherein the first and second light transmitting portions divide the lens member into two visually distinct halves, and a top portion of the light source holder is adjacent a portion of the lens member where the two light transmitting portions meet when the lens member in either the first or second orientation.

18. The device of claim 17 wherein the light source holder has its centre of gravity below its top portion such that the light source holder is maintained upright by gravity independent of a rotation of the lens member.

* * * * *